United States Patent [19]

Gotoh et al.

[11] Patent Number: 4,546,263

[45] Date of Patent: Oct. 8, 1985

[54] WEFT SENSOR FOR A LOOM

[75] Inventors: Miyuki Gotoh, Machida; Yoshimi Wada, Higashiyamato, both of Japan

[73] Assignee: Nissan Motor Company, Limited, Yokohama, Japan

[21] Appl. No.: 447,468

[22] Filed: Dec. 6, 1982

[51] Int. Cl.[4] ..... D03D 51/34

[52] U.S. Cl. ..... 250/561; 139/370.2; 250/571

[58] Field of Search ..... 250/561, 559, 571, 578; 139/370.2, 370.1, 353, 352, 336; 356/429, 430, 238

[56] References Cited

U.S. PATENT DOCUMENTS

| | | | |
|---|---|---|---|
| 3,853,408 | 12/1974 | Kaalverink | 250/571 |
| 4,178,969 | 12/1979 | Gotoh et al. | 139/336 X |
| 4,248,272 | 2/1981 | Wilson et al. | 250/561 X |
| 4,384,596 | 5/1983 | Brouwer et al. | 250/561 X |

FOREIGN PATENT DOCUMENTS 2105559 8/1972 Fed. Rep. of Germany .

*Primary Examiner*—Edward P. Westin

*Attorney, Agent, or Firm*—Schwartz, Jeffery, Schwaab, Mack, Blumenthal & Evans

[57] ABSTRACT

A weft sensor for a loom which can detect the presence or absence of a weft inserted into a warp shed at an acceptable moderate sensitivity on the basis of the majority decision of weft detection signals. When sensor sensitivity is too high, the weft sensor erroneously detects the fluff attached to the sensor as the presence of a weft, thus keeping the loom operated continuously. This erroneous detection reduces the quality of woven cloth. On the other hand, when sensor sensitivity is too low, the weft sensor erroneously detects a slender weft as the absence of a weft, thus keeping the loom stopped unnecessarily. This erroneous detection reduces the duty cycle of the loom. The weft sensor according to the present invention comprises a plurality of weft detectors and a majority decision circuit made up of a plurality of logical circuit elements such as AND, OR, NAND gates, etc.

12 Claims, 16 Drawing Figures

$\bar{Z} = A \cdot B + A \cdot C + B \cdot C$ (2/3)

| | | | | | | | | |
|---|---|---|---|---|---|---|---|---|
| A | 1 | 1 | 1 | 1 | 0 | 0 | 0 | 0 |
| B | 1 | 1 | 0 | 0 | 1 | 1 | 0 | 0 |
| C | 1 | 0 | 1 | 0 | 1 | 0 | 1 | 0 |
| Z | 1 | 1 | 1 | 0 | 1 | 0 | 0 | 0 |

$Z = A \cdot B + A \cdot C + B \cdot C$ (2/3)

| | | | | |
|---|---|---|---|---|
| A | 1 | 1 | 0 | 1 |
| B | 1 | 0 | 1 | 1 |
| C | 0 | 1 | 1 | 1 |
| Z | 1 | 1 | 1 | 1 |

FIG. 6(B)

$Z = A \cdot B + A \cdot C + A \cdot D + B \cdot C + B \cdot D + C \cdot D$ (2/4)

| | | | | | | | | | | | | | | | | |
|---|---|---|---|---|---|---|---|---|---|---|---|---|---|---|---|---|
| A | 1 | 1 | 1 | 1 | 0 | 1 | 1 | 1 | 0 | 0 | 0 | 1 | 0 | 0 | 0 | 0 |
| B | 1 | 1 | 1 | 0 | 1 | 1 | 0 | 0 | 0 | 1 | 1 | 0 | 1 | 0 | 0 | 0 |
| C | 1 | 1 | 0 | 1 | 1 | 0 | 1 | 0 | 1 | 0 | 1 | 0 | 0 | 1 | 0 | 0 |
| D | 1 | 0 | 1 | 1 | 1 | 0 | 0 | 1 | 1 | 1 | 0 | 0 | 0 | 0 | 1 | 0 |
| Z | 1 | 1 | 1 | 1 | 1 | 1 | 1 | 1 | 1 | 1 | 1 | 0 | 0 | 0 | 0 | 0 |

FIG. 7(B)

$Z = A \cdot B \cdot C + A \cdot B \cdot D + A \cdot B \cdot E + A \cdot C \cdot D + A \cdot C \cdot E + A \cdot D \cdot E + B \cdot C \cdot D + B \cdot C \cdot E + B \cdot D \cdot E + C \cdot D \cdot E$ (2/4)

| | | | | | | | | | | | | | | | | |
|---|---|---|---|---|---|---|---|---|---|---|---|---|---|---|---|---|
| A | 1 | 1 | 1 | 1 | 1 | 1 | 1 | 1 | 0 | 0 | 0 | 0 | 0 | 0 | 0 | 0 |
| B | 1 | 1 | 1 | 1 | 0 | 0 | 0 | 0 | 1 | 1 | 1 | 1 | 0 | 0 | 0 | 0 |
| C | 1 | 1 | 0 | 0 | 1 | 1 | 0 | 0 | 1 | 1 | 0 | 0 | 1 | 1 | 0 | 0 |
| D | 1 | 0 | 1 | 0 | 1 | 0 | 1 | 0 | 1 | 0 | 1 | 0 | 1 | 0 | 1 | 0 |
| E | 1 | 1 | 1 | 1 | 1 | 1 | 1 | 1 | 1 | 1 | 1 | 1 | 1 | 1 | 1 | 1 |
| Z | 1 | 1 | 1 | 1 | 1 | 1 | 1 | 0 | 1 | 1 | 1 | 0 | 1 | 0 | 0 | 0 |

$Z = A \cdot B \cdot C + A \cdot B \cdot D + A \cdot C \cdot D + B \cdot C \cdot D$ (3/4)

| | | | | | |
|---|---|---|---|---|---|
| A | 1 | 1 | 1 | 0 | 1 |
| B | 1 | 1 | 0 | 1 | 1 |
| C | 1 | 0 | 1 | 1 | 1 |
| D | 0 | 1 | 1 | 1 | 1 |
| Z | 1 | 1 | 1 | 1 | 1 |

$$\bar{Z} = A\cdot B\cdot C + A\cdot B\cdot D + A\cdot B\cdot E + A\cdot C\cdot D + A\cdot C\cdot E$$
$$A\cdot D\cdot E + B\cdot C\cdot D + B\cdot C\cdot E + B\cdot D\cdot E + C\cdot D\cdot E \quad (3/5)$$

| | | | | | | | | | | |
|---|---|---|---|---|---|---|---|---|---|---|
| A | 1 | 1 | 1 | 1 | 1 | 1 | 0 | 0 | 0 | 0 |
| B | 1 | 1 | 1 | 0 | 0 | 0 | 1 | 1 | 1 | 0 |
| C | 1 | 0 | 0 | 1 | 1 | 0 | 1 | 1 | 0 | 1 |
| D | 0 | 1 | 0 | 1 | 0 | 1 | 1 | 0 | 1 | 1 |
| E | 0 | 0 | 1 | 0 | 1 | 1 | 0 | 1 | 1 | 1 |
| $\bar{Z}$ | 1 | 1 | 1 | 1 | 1 | 1 | 1 | 1 | 1 | 1 |

WEFT SENSOR FOR A LOOM

BACKGROUND OF THE INVENTION

1. Field of the Invention

The present invention relates generally to a weft sensor for a loom and more specifically to a weft sensor having a plurality of weft-detection means for reliably detecting the presence or absence of a weft inserted into a warp shed of a loom.

2. Description of the Prior Art

The background of the present invention will be explained with respect to its application to an optical weft sensor for an air-jet loom, by way of example.

As is well known, an optical weft sensor is provided for an air-jet loom in order to optically detect that a weft thread is securely inserted into air-guide plates having an air-guide opening and a weft-removing slot respectively and arranged in the direction of weft insertion. The optical weft sensor comprises a light-emitting section and a light-receiving section for detecting the presence or absence of weft in dependence upon the change in magnitude of the received light, which is caused when a weft is removed through the weft-removing slots of the air guide plates and across an optical axis formed between the light-emitting section and the light-receiving section during the beat-up stage. Further, the optical weft sensor is usually attached to one air-guide plate fixed at the one end of the reed holder disposed at a position remote from a fluid nozzle and the loom is stopped when the weft sensor detects the absence of a weft thread.

In the prior-art optical weft sensor, however, there exist some problems or shortcomings as follows:

Since the diameter of a weft is small and additionally fluff occasionally attaches to the weft-removing slot of the air-guide plate, the detected signal voltage level indicative of the presence of a weft is relatively low and noise signal level due to the presence of fluff is relatively high.

Additionally, since a pair of light-emitting and light-receiving sections (referred to as optical weft-detection means) are fixed to the air guide plate and therefore the optical weft-detection means is moved to and fro all the time during the beat-up motion, the lead connected between the optical weft-detection means and the detection circuit is alway moved to and fro and therefore the lead tends to be frayed (some parts of a plurality of copper wires are broken off). If the lead is completely broken off, since the detection circuit can stop the loom, no serious problem arises; however, in case the lead is frayed, that is, in case the lead is imperfectly connected, the lead will generate noise signals which make even more difficult the accurate detection of the presence of a weft thread.

Therefore, in the case where only a single optical weft-detection means having a pair of light-emitting section and light-receiving section is provided for detecting the presence or absence of a weft inserted into the openings of the air-guide plates, it is very difficult to adjust the sensor sensitivity at an acceptable moderate level. To explain in more detail, if the sensor sensitivity is too high, when fluff attaches to the weft-detection means or the sensor lead is imperfectly connected, the sensor will detect this state as the presence of a weft and keep the loom operating continuously, in spite of the fact that a weft is not inserted, thus causing the deterioration of quality of woven cloth (referred to as erroneous weft-presence detection due to high sensitivity). In contrast with this, if the sensor sensitivity is too low, whenever a slender weft thread is inserted, the sensor will detect this state as the absence of a weft and stop the loom unnecessarily, in spite of the fact that a weft is inserted, thus causing the lowering of loom duty cycle (ratio of time in use to total time) (referred to as erroneous weft-absence detection due to low sensitivity).

In the case where a single light-emitting section is provided on one side of the weft inserting channel at the opposite end of the weft inserting nozzle and a plurality of light-receiving sections are provided on the other side thereof, being connected to an OR gate, for detecting the presence or absence of a weft, since the loom is stopped only when all the light-receiving sections detect the absence of the weft, if fluff attaches to the light-receiving section, the sensor will detect this state as presence of a weft and keeps the loom operating, thus causing the deterioration of woven cloth.

The arrangement of the latter prior-art optical weft sensor for a loom will be described in more detail hereinafter with reference to the attached drawing under DETAILED DESCRIPTION OF THE PREFERRED EMBODIMENTS.

SUMMARY OF THE INVENTION

With these problems in mind, therefore, it is the primary object of the present invention to provide an optical weft sensor for a loom which can detect the presence or absence of a weft inserted into a warp shed at an acceptable moderate sensitivity on the basis of the majority decision of at least half of weft detection signals outputted from a plurality of weft detection means; that is, which can effectively prevent both erroneous weft-presence detection due to high sensor sensitivity and erroneous weft-absence detection due to low sensor sensitivity.

To achieve the above mentioned object, the weft sensor according to the present invention comprises a plurality of weft-detection means and a majority decision means for outputting a weft-presence decision signal when a majority of at least half of the weft detection means detect the presence of a weft.

Further, the majority decision means is made up of a plurality of logical elements such as OR, AND gates etc., by which the logical AND product of each possible combination of at least half of the number of the weft detection means is first found and then the logical OR sum of all the AND products is found in order to output a weft-presence decision signal.

BRIEF DESCRIPTION OF THE DRAWINGS

The features and advantages of the weft sensor for a loom according to the present invention will be more clearly appreciated from the following description taken in conjunction with the accompanying drawings in which like reference numerals designate corresponding elements or sections throughout the drawings and in which;

FIG. 6(B) is a truth table of the third embodiment according to the present invention shown in FIG. 6(A), by which the loom is kept operated when two-fourths or more of the weft detection means detect the presence of weft;

FIG. 7(B) is a truth table of the fourth embodiment according to the present invention shown in FIG. 7(A), by which the loom is kept operated when two-fourths or more of the weft detection means detect the presence of weft;

DETAILED DESCRIPTION OF THE PREFERRED EMBODIMENTS

To facilitate understanding of the present invention, a brief reference will be made to a prior-art optical weft sensor for a loom, with reference to the attached drawings.

Figure 1:
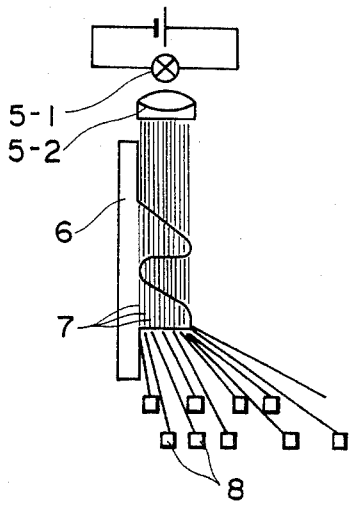
FIG. 1 PRIOR ART
FIG. 1 is a diagrammatical illustration showing an exemplary prior-art optical weft sensor for a loom in which a plurality of light-receiving sections are provided.

FIG. 1 shows an example of a prior-art optical weft sensor for a loom which includes a plurality of light-receiving sections. In FIG. 1, the reference numeral 5-1 denotes a light-emitting section; the reference numeral 5-2 denotes a collimator lens; the reference numeral 6 denotes a U-shaped reed blade; the reference numeral 7 denotes the bundle of optical fibers; the reference numeral 8 denotes a plurality of light-receiving elements.

Figure 2:
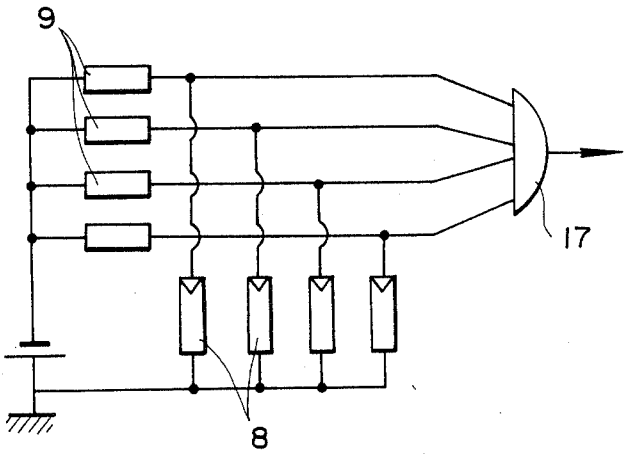
FIG. 2 PRIOR ART
FIG. 2 is a schematic block diagram of the prior-art optical weft sensor for a loom shown in FIG. 1.

FIG. 2 shows the circuit diagram of this prior-art weft sensor shown in FIG. 1, in which the reference numeral 9 denotes a plurality of resistors, and the reference numeral 17 denotes an OR gate.

In FIG. 2, the light-receiving sections 8 (four being indicated in this figure) are connected in series with four resistors 9, respectively, across a power supply. Each of the junction points between the light-receiving sections and the resistors is independently connected to each input terminal of the OR gate 17. In the case of the absence of a weft, all the light-receiving sections 8 receive the maximum quantity of light and therefore the resistances thereof drop to a low value. As a result, each of the voltage levels at the junction points drops to a L-voltage level and therefore the OR gate 17 outputs a L-voltage level signal indicative of the absence of a weft in order to stop the loom. However, in the case of the presence of a weft, at least one of the light-receiving sections 8 receives a quantity of light smaller than the maximum one and therefore the resistance thereof increase to a high value. As a result, at least one of the voltage levels at the junction points rises to a H-voltage level and therefore the OR gate 17 outputs a H-voltage level signal indicative of the presence of a weft in order to keep operating the loom continuously.

In this prior-art weft sensor, however, since the absence of a weft can be detected only when all the light-receiving sections 8 receive the light emitted from the light-emitting section 5-1, if fluff attaches between the light-emitting section 5-1 and at least one of the light-receiving sections 8, the sensor will detect this state as presence of a weft and keeps the loom operating continuously, in spite of the fact that a weft is not inserted, thus causing the deterioration of quality of woven cloth. This is called erroneous weft-presence detection due to high sensitivity.

In view of the above description, reference is now made to a first embodiment of a weft sensor for a loom according to the present invention with respect to its application to an air-jet loom, with reference to FIGS. 3, 4(A), 4(B) and 4(C).

Figure 3:
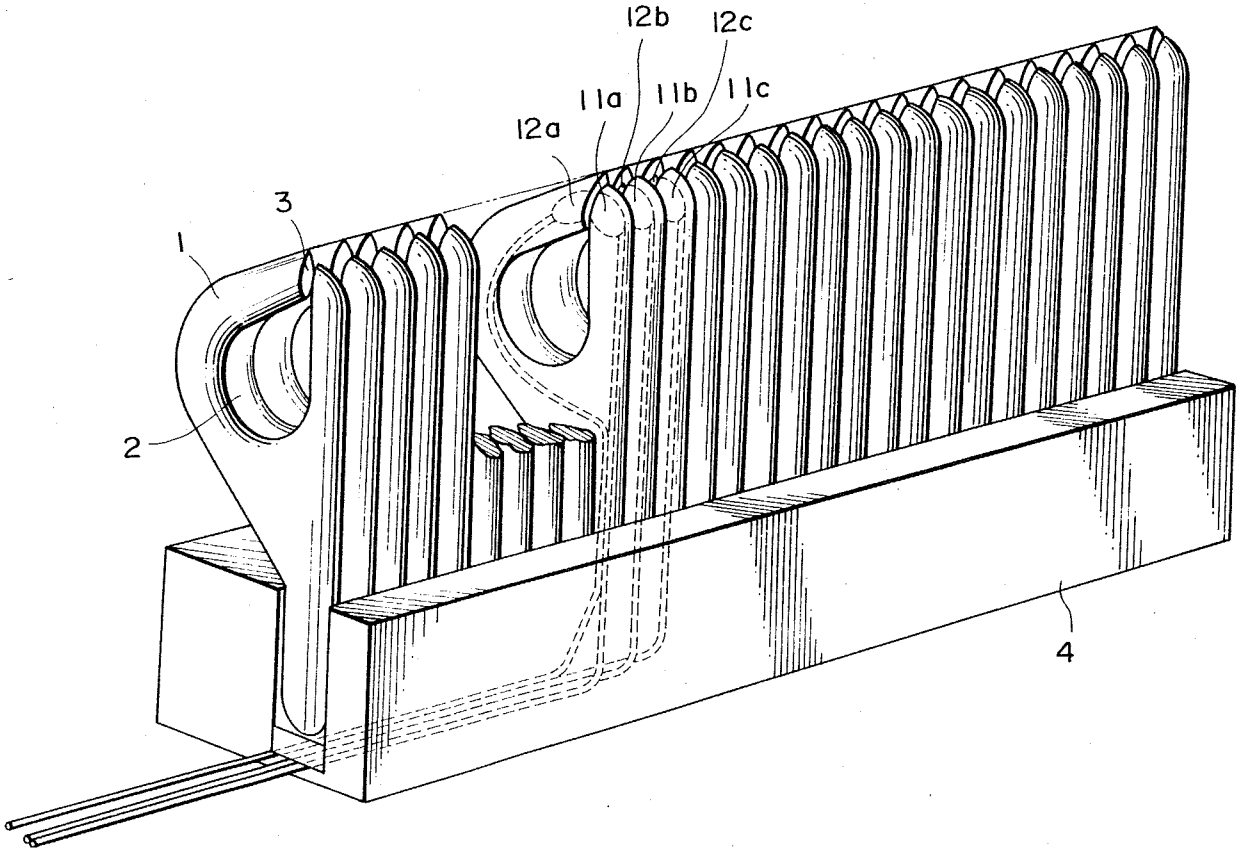
FIG. 3 is a perspective view of an arrangement of air-guide plates, in which a plurality of pairs of the light-emitting and light-receiving sections of the optical weft sensor according to the present invention are disposed.

In FIG. 3, the reference numeral 1 denotes a plurality of air guide plates, each of which has an air-guide opening 2 and a weft-removing slot 3. These air-guide plates 1 are arranged on an air-guide plate holder 4 at regular intervals in order to form an air guide passage for inserting a weft through a train of the openings 2. Further, in an actual loom, the holder 4 is usually divided into several pieces in the longitudinal direction. However, only a single air-guide holder 4 disposed at a position remote from an air nozzle (not shown) is illustrated in FIG. 3.

In three appropriate air-guide plates 1 fixed to the air-guide holder 4 disposed at a position remote from the air nozzle, there are provided three weft-detection means 10 including, for instance, three pairs of light-emitting sections 11*a*, 11*b*, and 11*c* and light-receiving sections 12*a*, 12*b* and 12*c* on either side of three weft-removing slots, respectively, in such a way as to face each other. Therefore, whenever a weft inserted into the train of the air-guide openings 2 is removed through the weft-removing slots 3 at an appropriate timing during the beat-up stage, since the weft moves across the optical axis formed between the light-emitting sections and the light-receiving sections, the magnitude of the light received by the light-receiving sections will change. In more detail, since the magnitude of the light is reduced whenever a weft is removed, the light-receiving sections output a L-voltage level signal indicative of the presence of a weft, respectively. Therefore, it is possible to obtain a weft-presence detection signal of "1" by differentiating the leading edge of this L-voltage level signal and by inverting the differentiated signal.

Figure 4A:
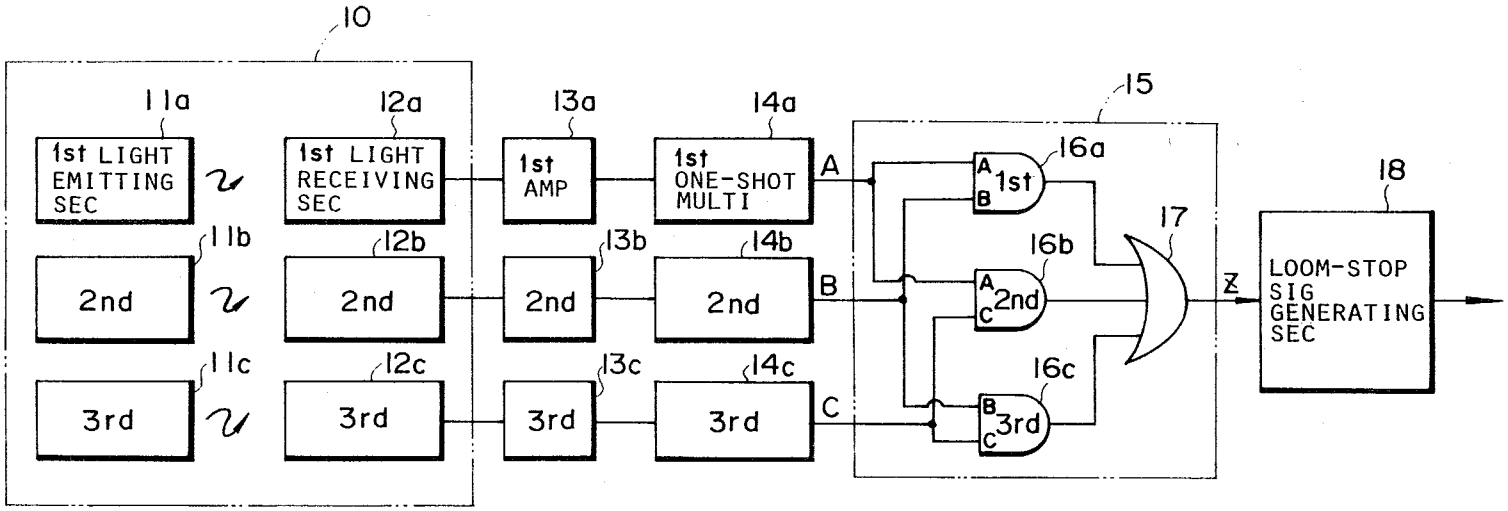
FIG. 4(A) is a schematic block diagram of a first embodiment of the optical weft sensor according to the present invention, in which three AND gates and an OR gate are incorporated therein.

FIG. 4(A) shows a schematic block diagram of a first embodiment of the weft sensor according to the present invention. In the figure, the reference numerals 13*a* to 13*c* denote three amplifiers; the reference numerals 14*a* to 14*c* denote three one-shot multivibrators; the reference numerals 16*a* to 16*c* denote three AND gates; the reference numeral 17 denotes an OR gate; and the reference numeral 18 denotes a loom-stopping signal generating section. Further, in FIG. 4(A), the reference numeral 15 denotes a majority decision circuit including the three AND gates 16*a* to 16*c* and the one OR gate 17.

As depicted in FIG. 4(A), the output signal A from the first one-shot multivibrator 14*a* is applied to the first AND gate 16*a* and the second AND gate 16*b;* the output signal B from the second one-shot multivibtrator 14*b* is applied to the first AND gate 16*a* and the third AND gate 16*c;* the output signal C from the third one-shot multivibrator 14*c* is applied to the second AND gate 16*b* and the third AND gate 16*c,* respectively. Further, all the signals outputted from the three AND gates are applied to the OR gate 17, and the signal Z outputted from the OR gate 17 is applied to the loom-stopping signal generating section 18. In this majority decision circuit 15, the OR gate 17 outputs a H-voltage level (or "1") signal Z when the sensor detects the presence of a weft.

Figures 4B, 4C:
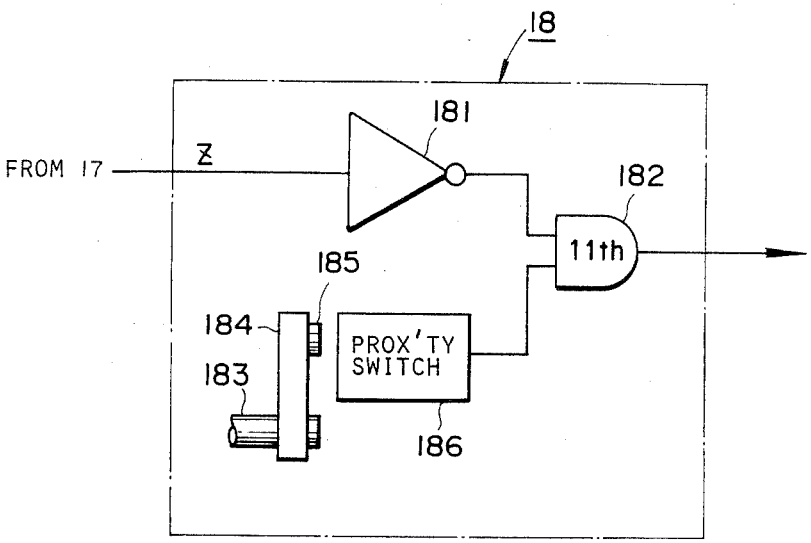
FIG. 4(B) is a schematic block diagram partly including a diagrammatical view of a loom-stop signal generating section for use with the first embodiment of the optical weft sensor shown in FIG. 4(A)
FIG. 4(C) is a truth table of the first embodiment according to the present invention shown in FIG. 4(A), by which the loom is kept operated when two-thirds or more of the weft detection means detect the presence of weft.

FIG. 4(B) shows the circuit diagram of the loom-stopping signal generating section 18, in which the reference numeral 181 denotes an inverting amplifier; the reference numeral 182 denotes an AND gate; and the reference numeral 186 denotes a proximity switch. This proximity switch 186 outputs a H-voltage level signal when a metal member 185 comes near the proximity switch 186. The metal member 185 is fixed to an arm 184 and rotates around a shaft 183 in synchronization with the movement of the loom. Further, the proximity switch 186 outputs a H-voltage level signal only when the reed wires are at the beat-up stage.

Accordingly, even if the majority decision circuit 15 outputs a L-voltage level signal (or "0") indicative of absence of a weft (inverted into H-level by the inverting amplifier 181), when the proximity switch 186 outputs a L-voltage level signal, the loom-stopping signal generating section 18 does not output a H-voltage level to stop the loom. In other words, the loom-stopping signal generating section 18 outputs a H-voltage level signal to stop the loom only when the majority decision circuit 15 outputs a L-voltage level signal indicative of absence of a weft and additionally the proximity switch 186 outputs a H-voltage level signal indicative of the beat-up stage.

Now follows a description of the operation of the first embodiment shown in FIGS. 4(A) and 4(B).

When the optical weft-detection means 10 including three light-emitting sections 11*a* to 11*c* and three light-receiving sections 12*a* to 12*c* detects the presence of a weft, each light-receiving section 12*a,* 12*b* or 12*c* outputs a H-voltage level signal (or a signal indicative of logical "1"). Therefore, after being amplified via each of the three amplifiers 13*a* to 13*c,* the signal from the light-receiving section 12*a,* 12*b* or 12*c* triggers the one-shot multivibrator 14*a,* 14*b* or 14*c,* so that the weft-presence signal is waveform-shaped into a signal having an appropriate voltage level and pulse width. Here, the logical signal outputted from the first one-shot multivibrator 14*a* is labeled A; the logical signal outputted from the second one-shot multivibrator 14*b* is labeled B; and the logical signal outputted from the third one-shot multivibrator 14*c* is labeled C.

These three logical signals A, B and C are applied to the majority decision circuit 15 including three AND gates 16*a* to 16*c* and an OR gate 17. As depicted in FIG. 4(A), the signals A and B are inputted to the first AND gate 16*a;* the signals A and C are inputted to the second AND gate 16*b;* the signals B and C are inputted to the third AND gate 16*c;* respectively; and all the signals from the three AND gates 16*a,* 16*b,* and 16*c* are inputted to the OR gate 17; therefore, it is possible to obtain a logical expression as follows:

$$Z=A\cdot B+A\cdot C+B\cdot C$$

where Z denotes a logical signal from the OR gate 17, "·" denotes logical product and "+" denotes logical sum.

FIG. 4(C) shows the truth table (Boolean operation table) of the above expression. As depicted in the figure, in the case where all the three light-receiving sections 12*a* to 12*c* detect the presence of a weft, since the truth table indicates that A=1, B=1, C=1, all the AND gates 16*a* to 16*c* output a signal of "1". As a result, the OR gate 17 outputs a signal of "1" (Z=1), indicating that a weft is present. Since this weft-presence signal (Z=1) is inverted by the inversion amplifier 181 into a L-voltage level signal, AND gate 182 will not output a H-voltage level signal to stop the loom even if the proximity switch 186 output a H-voltage level signal.

In the case where only the first and second light-receiving sections 12*a* 12*b* detect the presence of a weft but the third light-receiving section 12*c* does not detect the presence of a weft, since the truth table indicates that A=1, B=1, C=0, although the second and third AND gates 16*b* and 16*c* output a signal of "0", only the first AND gate 16*a* outputs a signal of "1". As a result, the OR gate 17 outputs a signal of "1" (Z=1), indicating that a weft is present. Therefore, in this case, the loom will not be stopped.

Additionally, in the case when only the first light-receiving section 12*a* detects the presence of a weft but the second and third light-receiving sections 12*b* and 12*c* do not detect the presence of a weft, since the truth table indicates that A=1, B=0, C=0, all the AND gates 16*a* to 16*c* output a signal of "0" (Z=0), indicating that a weft is absent. Since this weft-absence signal (Z=0) is inverted by the inversion amplifier 181 into a H-voltage level signal, the eleventh AND gate 182 output a H-voltage level signal to stop the loom only when the proximity switch 186 outputs a H-voltage level signal.

In the case where the three light-receiving sections 12a to 12c all detect the absence of a weft, since the truth table indicates that A=0, B=0, C=0, all the AND gates 16a to 16c output a signal of "0". As a result, the OR gate 17 outputs a signal of "0" (Z=0), indicating that a weft is absent.

Further, it should be noted that the loom is stopped from operation only when the sensor detects the absence of a weft at an appropriate timing defined by the proximity switch 186 closed during the beat-up stage.

To explain briefly, in this first embodiment, the weft sensor determines that a weft is present when two or more light-receiving sections 12a to 12c output a signal of "1" indicative of weft presence and that a weft is absent even if only one light-receiving section 12a, 12b, or 12c outputs a signal of "1" indicative of weft presence. When all of the light-receiving sections 12a to 12c do not output a signal of "1", the sensor determines, of course, that a weft is absent.

As described above, in the first embodiment of the weft sensor according to the present invention, the presence or absence of a weft is determined by the majority decision of two-thirds or more of weft detection signals outputted from three weft detection means.

Here, the erroneous detection ratio will be described on the basis of the above logical expression.

The assumption is made that the odds of an detection ratio due to high sensitivity (fluff is detected as a weft) is 1/10 when a single weft detection means is provided. In this case, the erroneous weft-presence detection ratio in the present invention can be reduced as follows:

$$AB-+AC+BC=(1/10\times 1/10)+(1/10\times 1/10)+(1/10-\times 1/10)=3/100$$

On the other hand, the assumption is made that the odds of an erroneous weft-absence detection ratio due to low sensitivity (a weft is not detected) is 1/100 when a single weft detection means is provided. In this case, the erroneous weft-absence detection ratio in the present invention can be reduced as follows:

$$AB-+AC+BC=(1/100\times 1/100)+(1/100\times 1/100)+(-1/100\times 1/100)=3/10000$$

Therefore, it is possible to reduce the erroneous detection ratio markedly, even if the ordinary weft sensor is used under the same condition. In other words, it is possible to improve the quality of woven cloth without lowering the productivity (loom duty cycle).

Figures 5A, 5B:
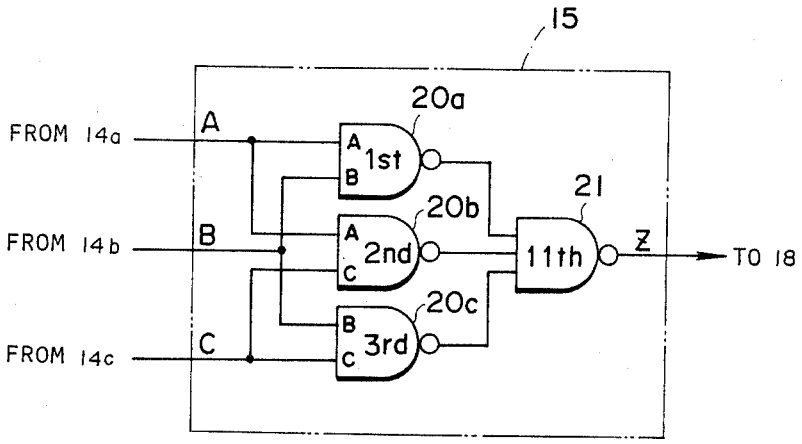
FIG. 5(A) is a schematic block diagram of a second embodiment of the optical weft sensor according to the present invention, in which four NAND gates are incorporated therein.
FIG. 5(B) is a truth table of the second embodiment according to the present invention shown in FIG. 5(A), by which the loom is kept operated when two-thirds or more of the weft detection means detect the presence of weft.

FIG. 5(A) shows a second embodiment of the weft sensor according to the present invention, in which the majority decision circuit 15 is made up of a plurality of NAND gates, that is, a first, second and third NAND gates 20a to 20c and NAND gate 21.

In the same way as in the description of the previous embodiment, the logical signal outputted from the first one-shot multivibrator 14a is labeled A; the logical signal outputted from the second one-shot multivibrator 14b is labeled B; the logical signal outputted from the third one-shot multivibrator 14c is labeled C.

These three logical signals A, B and C are applied to the majority decision circuit 15.

As depicted in FIG. 5(A), the signals A and B are inputted to the first NAND gate 20a; the signals A and C are inputted to the second NAND gate 20b; the signals B and C are inputted to the third NAND gate 20c, respectively; and all the signals from the three NAND gates 20a, 20b and 20c are inputted to the eleventh NAND gate 21; therefore, it is possible to obtain a logical expression as follows:

$$Z=(A\cdot B)\cdot(A\cdot C)\cdot(B\cdot C)=A\cdot B+A\cdot C+B\cdot C$$

where Z denotes a logical signal from the NAND gate 21, and a bar over an expression denotes inverse or complement.

FIG. 5(B) shows the truth table of the above expression. Since this table is quite the same as that shown in FIG. 4(B), the description thereof is omitted herein.

To explain briefly, in this second embodiment, the weft sensor determines that a weft is present when two-thirds or more of the light-receiving sections 12a to 12c output of a signal of "1" indicative of weft presence and that a weft is absent even if only one of the light-receiving sections 12a to 12c outputs a signal of "1" indicative of weft presence. In other words, in the weft sensor of the second embodiment, the presence or absence of a weft is determined by the majority decision of two-thirds or more of the weft detection signals outputted from three weft detection means.

The above first and second embodiments describe the cases where an odd number of the weft detection means are used; however, it is also possible to detect the presence or absence of a weft on the basis of a similar technique by using an even number of the weft detection means.

Figure 6A:
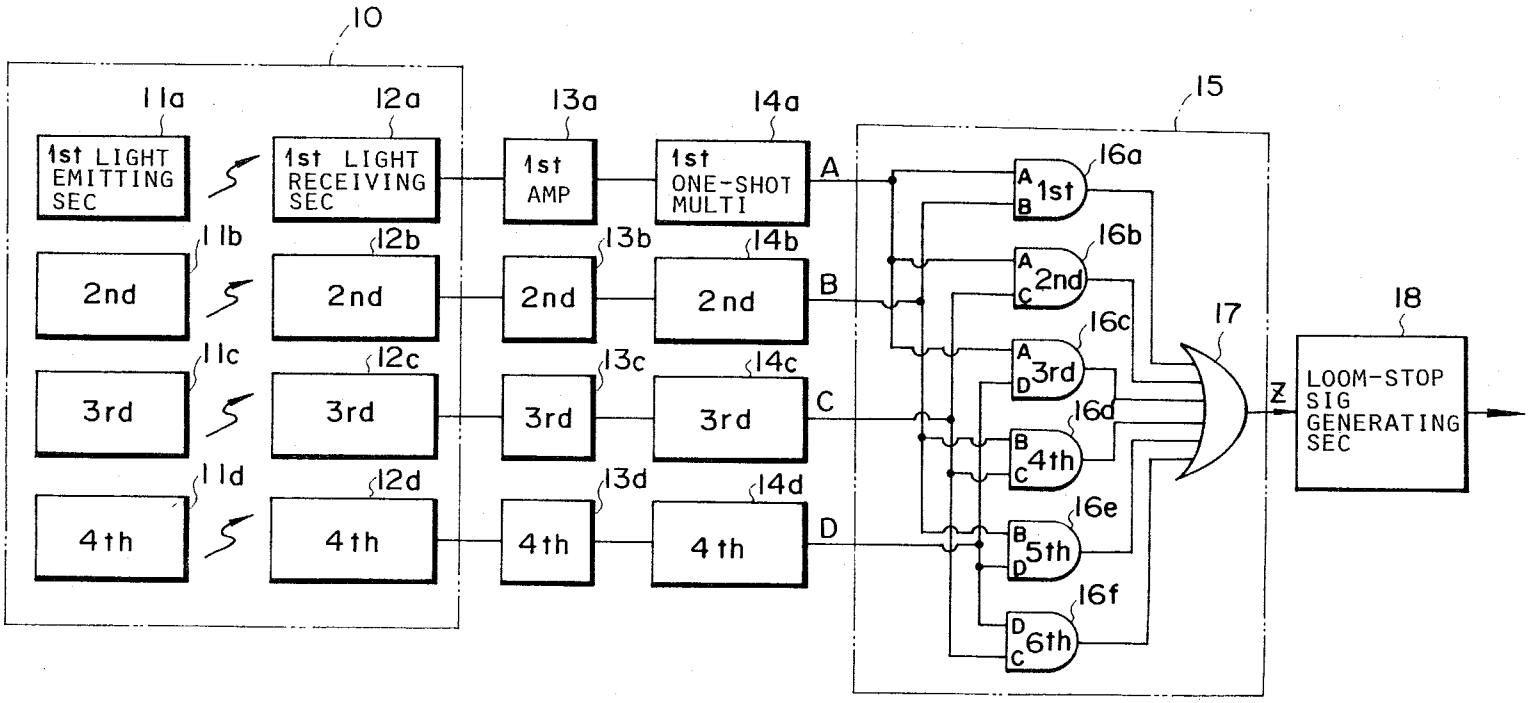
FIG. 6(A) is a schematic block diagram of a third embodiment of the optical weft sensor according to the present invention, in which six AND gates and an OR gate are incorporated therein.

FIG. 6(A) shows a third embodiment according to the present invention, in which four weft detection means are provided.

In this embodiment, the logical signals A and B are inputted to the first AND gate 16a; the signals A and C are inputted to the second AND gate 16b; the signals A and D are inputted to the third AND gate 16c; the signals B and C are inputted to the fourth AND gate 16d; the signals B and D are inputted to the fifth AND gate 16e; the signals D and C are inputted to the sixth AND gate 16f, respectively; and all the signals from the six AND gates 16a to 16f are inputted to the OR gate 17; therefore, it is possible to obtain a logical expression as follows:

$$Z=A\cdot B+A\cdot C+A\cdot D+B\cdot C+B\cdot D+C\cdot D$$

FIG. 6(B) shows the truth table of the above expression.

In this third embodiment, the weft sensor determines that a weft is present when two or more light-receiving sections 12a to 12d output a signal of "1" indicative of weft presence and that a weft is absent even if only one light-receiving section 12a, 12b, 12c, or 12d outputs a signal of "1" indicative of weft presence. When all of the light-receiving sections 12a to 12c does not output a signal of "1", the sensor determines, of course, that a weft is absent.

In summary, in this third embodiment of the weft sensor according to the present invention, the presence or absence of a weft is determined by the majority decision of at least half of the weft detection signals outputted from four weft detection means.

Figure 7A:
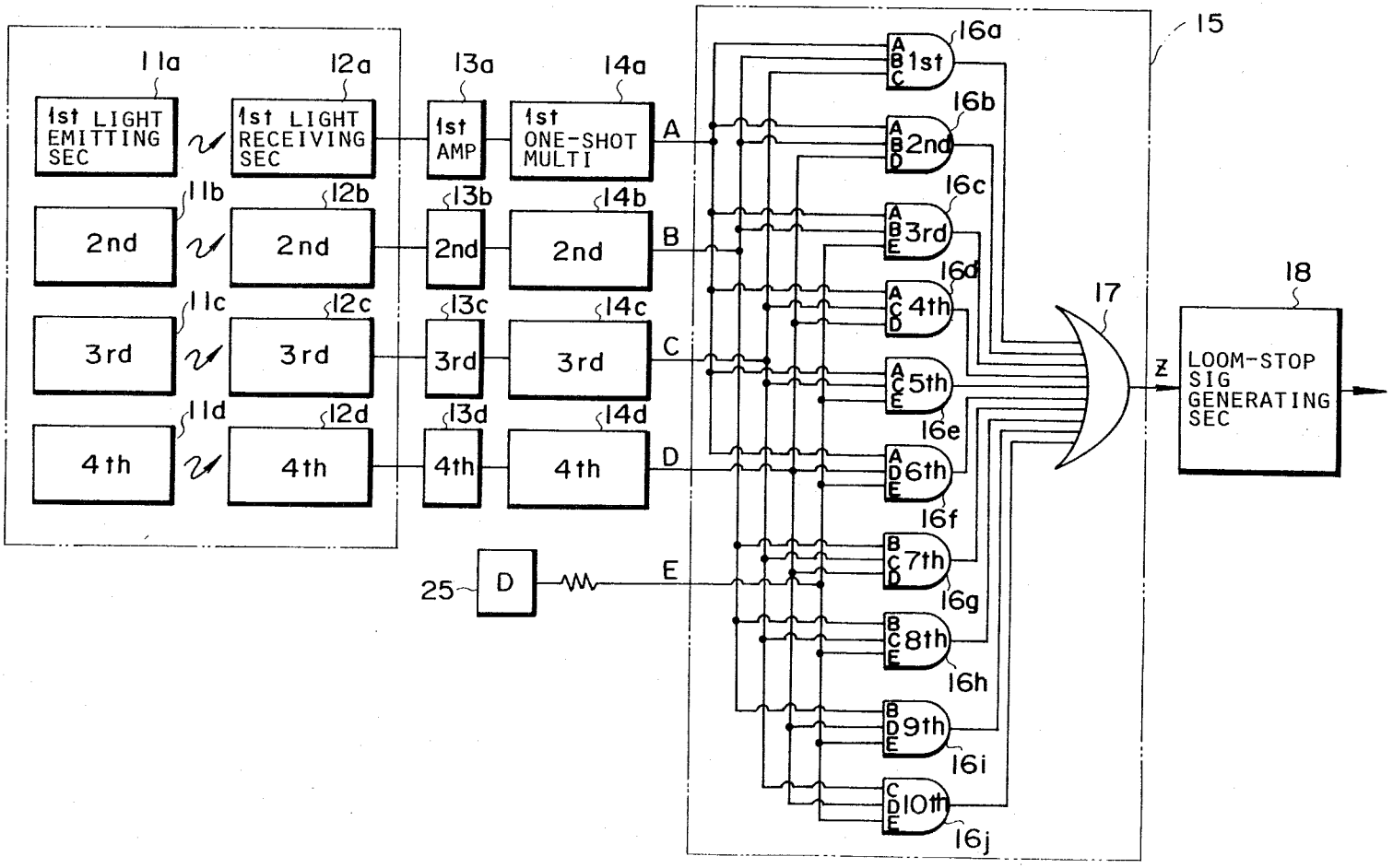
FIG. 7(A) is a schematic block diagram of a fourth embodiment of the optical weft sensor according to the present invention, in which ten AND gates and an OR gate are incorporated therein together with dummy signal generating means.

FIG. 7(A) shows a fourth embodiment of the weft sensor according to the present invention, in which there are provided four weft detection means and dummy signal generating means 25 for outputting a single dummy signal E of "1". When the weft sensor according to the present invention is configured by an appropriate commercially available integral circuit, especially when AND gates having three input terminals are used, this embodiment is advantageous.

In this embodiment, the logical signals A, B and C are inputted to the first AND gate 16*a;* the signals A, B and D are inputted to the second AND gate 16*b;* the signals A, B and E are inputted to the third AND gate 16*c;* the signals A, C, and D are inputted to the fourth AND gates 16*d;* the signals A, C and E are inputted to the fifth AND gate 16*e;* the signals A, D and E are inputted to the sixth AND gate 16*f;* the signals B, C and D are inputted to the seventh AND gate 16*g;* the signals B, C and E are inputted to the eighth AND gate 16*h;* the signals B, D and E are inputted to the ninth AND gate 16*i;* and the signals C, D and E are inputted to the tenth AND gate 16*j,* respectively; and all the signal from the ten AND gates 16*a* to 16*j* are inputted to the OR gate 17; therefore, the following logical expression can be obtained:

$$Z=A\cdot B\cdot C+A\cdot B\cdot D+A\cdot B\cdot E+A\cdot C\cdot D+A\cdot C\cdot E+A\cdot D\cdot E+B\cdot C\cdot D+B\cdot C\cdot E+B\cdot D\cdot E+C\cdot D\cdot E$$

FIG. 7(B) shows the truth table of the above expression.

In this fourth embodiment, the weft sensor determines that a weft is present when at last three light-receiving sections output a signal of "1" indicative of a weft presence and that a weft is absent even if only one light-receiving section 12*a,* 12*b,* 12*c* or 12*d* outputs a signal of "1" indicative of weft presence.

In summary, in this fourth embodiment of the weft sensor according to the present invention, the presence or absence of a weft is determined by the majority decision of two-fourths or more of the weft detection signals outputted from four weft detection means.

Figures 8A, 8B:
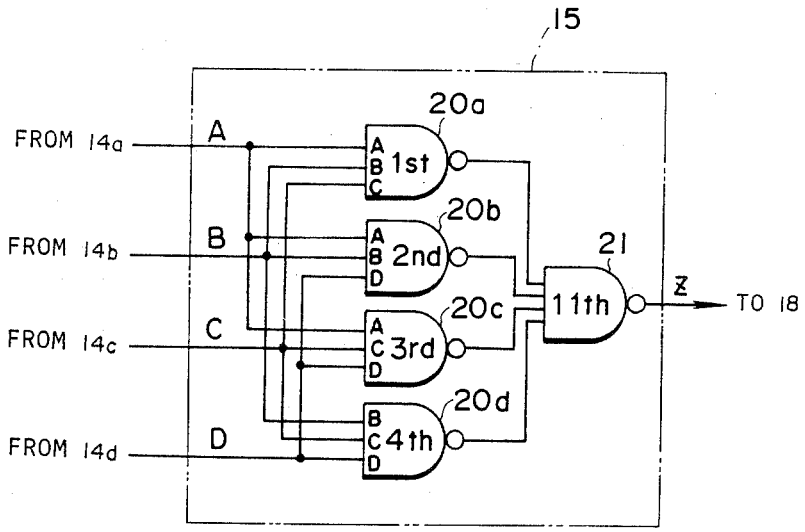
FIG. 8(A) is a schematic block diagram of a fifth embodiment of the optical weft sensor according to the present invention, in which five NAND gates are incorporated therein.
FIG. 8(B) is a truth table of the fifth embodiment according to the present invention shown in FIG. 8(A), by which the loom is kept operated when three-fourths or more of weft detection means detect the presence of weft.

FIG. 8(A) shows a fifth embodiment of the weft sensor according to the present invention, in which the majority decision circuit 15 is made up of four NAND gates 20*a,* 20*b,* 20*c* and 20*d* and an eleventh NAND gate 21.

The logical signals A, B and C are inputted to the first NAND gate 20*a;* the signals A, B and D are inputted to the second NAND gate 20*b;* the signals A, C and D are inputted to the third NAND gate 20*c;* and the signals B, C and D are inputted to the fourth NAND gate 20*d;* respectively, and all the signals from the four NAND gates 20*a,* 20*b,* 20*c* and 20*d* are inputted to NAND gate 21; therefore, the following logical expression can be obtained:

$$Z=(A\cdot B\cdot C)\cdot(A\cdot B\cdot D)\cdot(A\cdot C\cdot D)\cdot(B\cdot C\cdot D)=A\cdot B\cdot C+A\cdot B\cdot D+A\cdot C\cdot D+B\cdot C\cdot D$$

FIG. 8(B) shows the truth table of the above expression.

In this embodiment, the weft sensor determines that a weft is present when three or more light-receiving sections output a signal of "1" indicative of weft presence, respectively, and that a weft is absent even if two or less light-receiving sections output a signal of "1" indicative of weft presence.

In summary, in this fifth embodiment of the weft sensor according to the present invention, the presence or absence of a weft is determined by the majority decision of three-fourths or more of the weft detection signals outputted from four weft detection means.

Figures 9A, 9B:
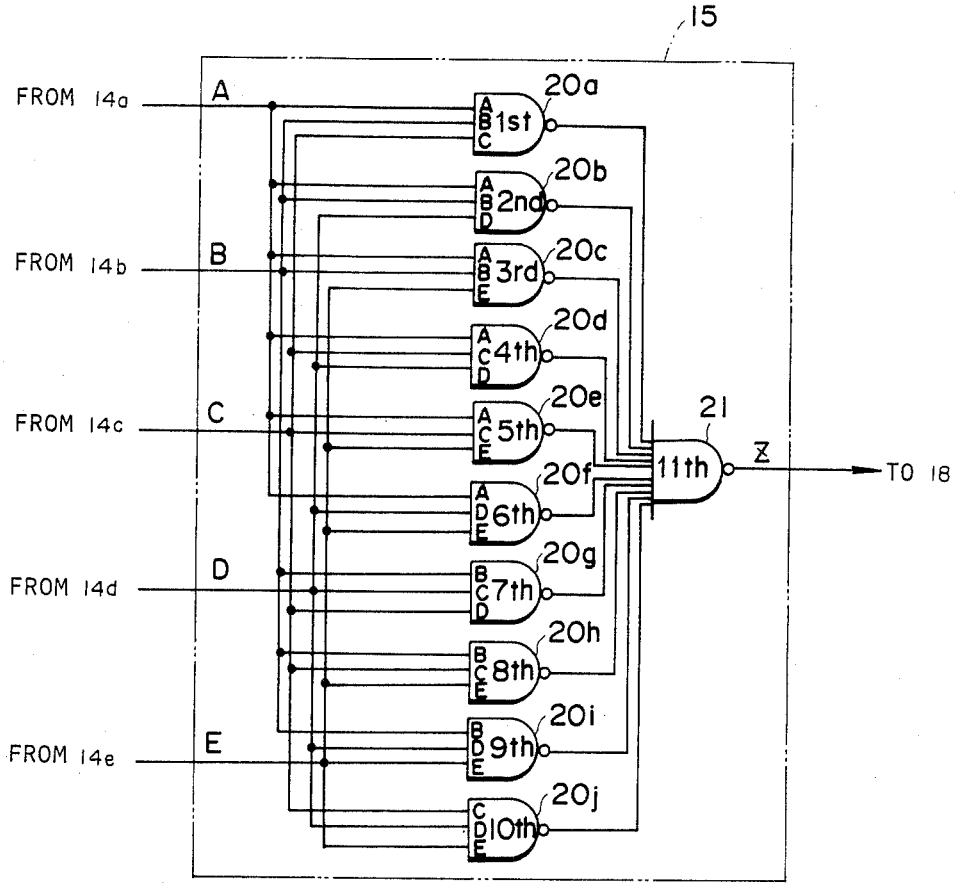
FIG. 9(A) is a schematic block diagram of a sixth embodiment of the optical weft sensor according to the present invention, in which eleven NAND gates are incorporated therein.
FIG. 9(B) is a truth table of the sixth embodiment according to the present invention shown in FIG. 9(A), by which the loom is kept operated when three-fifths or more of the weft detection means detect the presence of weft.

FIG. 9(A) shows a sixth embodiment of the weft sensor according to the present invention, in which the majority dicision circuit 15 is made up of ten NAND gates 20*a* to 20*j* and an eleventh NAND gate 21.

The logical signals A, B and C are inputted to the first NAND gate 20*a;* the signals A, B and D are inputted to the second NAND gate 20*b;* the signals A, B and E are inputted to the third NAND gate 20*c;* the signals A, C and D are inputted to the fourth NAND gate 20*d;* the signals A, C and E are inputted to the fifth NAND gate 20*e;* the signals A, D and E are inputted to the sixth NAND gate 20*f;* the signals B, C and D are inputted to the seventh NAND gate 20*g;* signals B, C and E are inputted to the eighth NAND gate 20*h;* and the signals B, D and E are inputted to the ninth NAND gate 20*i;* and signals C, D and E are inputted to the tenth NAND gate 20*j;* respectively, and all the signals from the ten NAND gates 20*a* to 20*j* are inputted to the eleventh NAND gate 21; therefore, the following logical expression can be obtained:

$$Z=A\cdot B\cdot C+A\cdot B\cdot D+A\cdot B\cdot E+A\cdot C\cdot D+A\cdot C\cdot E+A\cdot D\cdot E+B\cdot C\cdot D+B\cdot C\cdot E+B\cdot D\cdot E+C\cdot D\cdot E$$

FIG. 9(B) shows the truth table of the above expression.

In this sixth embodiment, the weft sensor determines that a weft is present when three or more light-receiving sections output a signal of "1" indicative of weft presence, respectively, and that a weft is absent even if two or less light-receiving sections output a signal of "1" indicative of weft presence.

In summary, in this sixth embodiment of the weft sensor according to the present invention, the presence or absence of a weft is determined by the majority decision of three-fifths or more of the weft detection signals outputted from five weft detection means.

As described above, in the case where logical elements of AND gates and an OR gate are used, the majority decision circuit 15 first finds the logical AND product of each possible combination of at least half of the number of the weft-detection means and next finds the logical OR sum of all of the AND products.

In the case where logical elements of NAND gates are used, the majority decision circuit 15 first finds the logical NAND product of each possible combination of at least half of the number of the weft detection means and next finds the logical NAND result of all of the NAND products Description has been made of an optical weft sensor including a plurality of pairs of light-emitting section and light-receiving section in order to disclose the weft sensor according to the present invention. However, it is also possible to apply the present invention to any kinds of weft sensors for a loom, for instance, to a piezoelectric-type weft sensor for a loom.

The method and apparatus for detecting the presence or absence of a weft in dependence upon a piezoelectric sensor, that is, a temporary rise in warp tension caused by an inserted weft during beat-up stage are disclosed in U.S. Pat. No. 3,678,969, naming as an inventor M. GOTOH, one of the coinventors herein, on July 25, 1972.

Furthermore, description has been made of an air-jet loom in which the optical weft sensor according to the present invention is mounted. However, it is of course possible to apply the present invention to any kinds of loom, for instance, to an ordinary loom, water-jet loom, etc.

As described above, in the weft sensor for a loom according to the present invention, since there are provided a plurality of weft detection means and a majority decision circuit therein, the presence of a weft can be determined only when half or more weft detection means detect the presence of a weft. Therefore, it is possible to freely set the sensitivity of the weft sensor at an acceptable moderate level on the basis of the majority decision. In other words, it is possible to reduce erroneous weft-presence detection due to high sensor sensitivity (fluff is detected as a weft) and erroneous weft-absence detection due to low sensor sensitivity (a weft is not detected). As a result, it is possible to improve the quality of woven cloth, while improving the loom duty cycle (ratio of time in use to total time).

It will be understood by those skilled in the art that the foregoing description is in terms of a preferred embodiment of the present invention wherein various changes and modifications may be made without departing from the spirit and scope of the invention, as set forth in the appended claims.

What is claimed is:

1. A weft sensor for a loom for detecting presence or absence of a weft inserted into a warp shed, which comprises:

(a) plural weft-detection means for detecting the presence or absence of the weft inserted into the warp shed and for outputting plural weft-presence detection signals independently when a weft is present in the warp shed;

(b) plural AND gates each connected to at least half of said plural weft-detection means for outputting a logical AND product signal, respectively, of each possible combination of at least half of the number of the weft-presence detection signals; and (c) an OR gate connected to said plural AND gates for outputting a logical OR sum signal of all of the logical AND product signals.

2. A weft sensor for a loom as set forth in claim 1, wherein said plural weft-detection means comprise three weft detection means, and wherein said majority decision means comprises:

(a) a first AND gate, the two input terminals of which are connected to said first and second weft-detection means;

(b) a second AND gate, the two input terminals of which are connected to said first and third weft-detection means;

(c) a third AND gate, the two input terminals of which are connected to said second and third weft-detection means; and (d) an OR gate, the three input terminals of which are connected to each output terminal of said three AND gates independently, for outputting a weft-presence decision signal when at least two of said weft-detection means output a weft-presence detection signal, independently.

3. A weft sensor for a loom as set forth in claim 1, wherein each of said plural weft-detection means comprises:

(a) light-emitting means disposed near a weft-removing slot formed in an air-guide plate in such a way that a weft removed through the slot will move across the optical axis of the light emitted from said light-emitting means; and (b) light-receiving means disposed near a weft-removing slot formed in an air-guide plate in such a way as to face said light-emitting means.

4. A weft sensor for a loom as set forth in claim 1, wherein the number of said plural weft-detection means is four, and wherein said majority decision means comprises:

(a) a first AND gate, the two input terminals of which are connected to said first and second weft-detection means;

(b) a second AND gate, the two input terminals of which are connected to said first and third weft-detection means;

(c) a third AND gate, the two input terminals of which are connected to said first and fourth weft-detection means;

(d) a fourth AND gate, the two input terminals of which are connected to said second and third weft-detection means;

(e) a fifth AND gate, the two input terminals of which are connected to said third and fourth weft-detection means; and (f) a sixth AND gate, the two input terminals of which are connected to said third and fourth weft-detection means; and (g) an OR gate, the six input terminals of which are connected to each output terminal of said six AND gates independently, for outputting a of weft-presence decision signal when at least two of said weft-detection means output a weft-presence detection signal, independently.

5. A weft-sensor for a loom as set forth in claim 1, wherein in the number of said plural weft-detection means is four, and wherein said majority decision means comprises:

(a) a dummy signal generating means for outputting a dummy signal;

(b) a first AND gate, the three input terminals of which are connected to said first, second and third weft detection means;

(c) a second AND gate, the three input terminals of which are connected to said first, second and fourth weft detection means;

(d) a third AND gate, the three input terminals of which are connected to said first and second weft-detection means and said dummy signal generating means;

(e) a fourth AND gate, the three input terminals of which are connected to said first, third and fourth weft-detection means;

(f) a fifth AND gate, the three input terminals of which are connected to said first and third weft-detection means and said dummy signal generating means;

(g) a sixth AND gate, the three input terminals of which are connected to said first and fourth weft-detection means and said dummy signal generating means;

(h) a seventh AND gate, the three input terminals of which are connected to said second, third and fourth weft-detection means;

(i) an eighth AND gate, the three input terminals of which are connected to said second and third weft-detection means and said dummy signal generating means;

(j) a ninth AND gate, the three input terminals of which are connected to said second and fourth weft-detection means and said dummy signal generating means;

(k) a tenth AND gate, the three input terminals of which are connected to said third and fourth weft-detection means and said dummy signal generating means; and (l) an OR gate, the ten input terminals of which are connected to each output terminal of said ten AND gates independently, for outputting a weft-presence decision signal when at least two of said weft-detection means output a weft-presence detection signal, independently.

6. A weft sensor for a loom as set forth in claim 1, wherein each of said plural weft-detection means comprises a piezoelectric pressure detector.

7. A weft sensor for a loom for detecting presence or absence of a weft inserted into a warp shed, which comprises:

(a) plural weft-detection means for detecting the presence or absence of the weft inserted into the warp shed and for outputting plural weft-presence detection signals independently when a weft is present in the warp shed;

(b) plural NAND gates each connected to at least half of said plural weft-detection means for outputting a logical NAND product signal, respectively, of each possible combination of at least half of the number of the weft-presence detection signals; and (c) a NAND gate connected to said plural NAND gates for outputting a logical NAND result signal of all of the logical NAND product signals.

8. A weft sensor for a loom as set forth in claim 7, wherein said plural weft-detection means comprise three weft detection means, and wherein said majority decision means comprises:

(a) a first NAND gate, the two input terminals of which are connected to said first and second weft-detection means;

(b) a second NAND gate, the two input terminals of which are connected to said first and third weft-detection means;

(c) a third NAND gate, the two input terminals of which are connected to said second and third weft-detection means; and (d) a NAND gate, the three input terminals of which are connected to each output terminal of said three NAND gates independently, for outputting a weft-presence decision signal when at least two of said weft-detection means output a weft-presence detection signal, independently.

9. A weft sensor for a loom as set forth in claim 7, wherein the number of said plural weft-detection means is four, and wherein said majority decision means comprises:

(a) a first NAND gate, the three input terminals of which are connected to said first, second and third weft-detection means;

(b) a second NAND gate, the three input terminals of which are connected to said first, second and fourth weft-detection means;

(c) a third NAND gate, the three input terminals of which are connected to said first, third and fourth weft-detection means;

(d) a fourth NAND gate, the three input terminals of which are connected to said second, third and fourth weft-detection means; and (e) a NAND gate, the four input terminals of which are connected to each output terminal of said four NAND gates independently, for outputting a weft-presence decision signal when at least three of said weft-detection means output a weft-presence detection signal, independently.

10. A weft-sensor for a loom as set forth on claim 7, wherein the number of said plural weft-detection means is five, and wherein said majority decision means comprises:

(a) a first NAND gate, the three input terminals of which are connected to said first, second and third weft detection means;

(b) a second NAND gate, the three input terminals of which are connected to said first, second and fourth weft detection means;

(c) a third NAND gate, the three input terminals of which are connected to said first, second and fifth weft-detection means;

(d) a fourth NAND gate, the three input terminals of which are connected to said first, third and fourth weft-detection means;

(e) a fifth NAND gate, the three input terminals of which are connected to said first, third and fifth weft-detection means;

(f) a sixth NAND gate, the three input terminals of which are connected to said first, fourth and fifth weft-detection means;

(g) a seventh NAND gate, the three input terminals of which are connected to said second, third and fourth weft-detection means;

(h) an eighth NAND gate, the three input terminals of which are connected to said second, third and fifth weft-detection means;

(i) a ninth NAND gate, the three input terminals of which are connected to second, fourth and fifth weft-detection means;

(j) a tenth NAND gate, the three input terminals of which are connected to said third, fourth and fifth weft-detection means; and (k) a NAND gate, the ten input terminals of which are connected to each output terminal of said ten NAND gates independently, for outputting a weft-presence decision signal when at least three of said weft-detection means output a weft-presence detection signal, independently.

11. A method of detecting the presence or absence of a weft inserted into a warp shed, which comprises the following steps of:

(a) detecting the presence or absence of a weft by a plurality of weft-detection means disposed at different positions and outputting a weft-presence detection signal, independently, when a weft is present;

(b) finding a logical AND product, respectively, of each possible combination of at least half of the number of the weft-detection means; and (c) finding a logical OR sum of all of the AND products.

12. A method of detecting presence or absence of a weft inserted into a warp shed, which comprises the following steps of:

(a) detecting the presence or absence of a weft by a plurality of weft-detection means disposed at different positions and outputting a weft-presence detection signal, independently, when a weft is present;

(b) finding a logical NAND product of each possible combination of at least half of the number of the weft detecting means; and (c) finding the logical NAND result of all of the NAND products.

* * * * *